United States Patent [19]

Fralish

[11] 4,385,457

[45] May 31, 1983

[54] SNOW CASTER

[75] Inventor: Mark R. Fralish, Berlin, Wis.

[73] Assignee: J. I. Case Company, Racine, Wis.

[21] Appl. No.: 309,570

[22] Filed: Oct. 8, 1981

[51] Int. Cl.[3] ..... E01H 5/09

[52] U.S. Cl. ..... 37/250; 37/259

[58] Field of Search ..... 37/43 R, 43 C, 43 D, 37/43 E, 53, 66, 81, 250, 259

[56] References Cited

U.S. PATENT DOCUMENTS

| | | | |
|---|---|---|---|
| 2,618,872 | 11/1952 | Gillies | 37/43 E |
| 2,632,263 | 3/1953 | Cooper | 37/43 E |
| 3,755,931 | 9/1973 | Gisler | 37/43 E |
| 4,190,972 | 3/1980 | Berner | 37/53 |
| 4,203,237 | 5/1980 | Enters et al. | 37/43 E |
| 4,325,195 | 4/1982 | Comer | 37/43 D |

*Primary Examiner*—E. H. Eickholt

*Attorney, Agent, or Firm*—Dressler, Goldsmith, Shore, Sutker & Milnamow, Ltd.

[57] ABSTRACT

A snow caster for use as a snow blower is disclosed having auger units which rotate and propel snow toward a fan rotating at a higher speed to propel the snow out of the snow caster. The fan is fixed on a drive shaft which extends within the auger units and is operably connected to the auger units by a speed reduction means.

25 Claims, 9 Drawing Figures

SNOW CASTER

TECHNICAL FIELD

This invention relates to snow casters and in particular snow casters used on snow blowers to remove snow from sidewalks, driveways and the like.

BACKGROUND OF THE INVENTION

Snow blowers have been used for years by home owners to remove snow from driveways, sidewalks and areas around their homes. Generally a snow blower consists of a snow caster having blades which move the snow and a drive unit including wheels and a power source such as an engine, to power the snow caster. The drive unit may be a wheeled cart or a lawn or garden tractor.

Generally snow casters have an auger that drives the snow to a fan unit which propels the snow up a chute and to one side of the snow caster. Snow casters come in two forms, single stage snow casters and a two stage snow casters. In the single stage snow caster, the fan unit is usually intergral with the auger blades. However, the single stage snow casters have a particular disadvantage. Because the fan unit and auger blades are mounted on the same drive shaft, they rotate together at the same velocity. When penetrating deep snow, the auger blades will move more snow toward the fan unit than it is capable of propelling through the chute at any given time. This reduces the efficiency of the single stage snow caster and limits the speed of snow clearing and the distance that the snow is thrown from the chute.

To solve these deficiencies in the single stage snow caster, the two stage snow caster was developed. In this arrangement the fan unit or second stage is separately powered at a higher rotational speed. By rotating at a higher speed the fan unit is able to keep up with the snow moved by the auger, even in deep snow. Because it is separately powered by another drive arrangement, the fan unit is mounted behind and transversely with respect to the auger.

However, the two stage snow caster has its own deficiencies. The transversely mounted second stage makes the snow caster assembly longer from front to back and the snow caster must be mounted further in front of a garden or lawn tractor. This mounting moves the center of gravity of the tractor much further forward reducing the traction of the tractor rear wheels. This is particularly detrimental with small lawn and garden tractors.

In a two stage snow caster, the snow is first moved longitudinally by the auger blades, then transversely into the second stage and finally vertically out of the snow caster. This is opposed to the single stage arrangement of moving longitudinally and then vertically. This multitude of direction changes effects the efficiency of the two stage snow caster and is particularly a problem when items such as sticks are accidentally encountered by the snow caster and become lodged somewhere in the second stage. Because the second stage is mounted behind the augers, it is difficult to remove sticks and similar objects.

Accordingly, it is desirable to produce a snow caster having the size and operation benefits of a single stage snow caster while maintaining the operational efficiency of a two stage snow caster. The snow caster of the present invention meets this desire.

SUMMARY OF THE INVENTION

The present invention is a snow caster which can be mounted on the front of a lawn or garden tractor to operate as a snow blower. Alternatively, the snow caster may be mounted on a wheeled cart having an engine to perform as a hand-pushed snow blower.

The snow caster of the present invention has an elongated housing with an opening along the front into which a material such as snow enters as the snow caster is moved forward. A fan fixed on a drive shaft rotates within the housing to propel snow through a discharge spout positioned on the back of the housing. An auger unit having an auger blade fixed on an auger tube also rotates in the housing with the drive shaft extending into the auger tube. The auger unit propels the snow toward the fan as it is rotated.

Preferably, the fan is mounted centrally on the shaft and the snow caster is provided with two auger units mounted opposite each other with respect to the fan. The auger units then propel the snow from either side toward the fan. A speed reduction means operably interconnects the drive shaft and the auger unit such that the auger unit rotates at a slower speed with respect to the drive shaft and fan.

Generally, the speed reduction means is a gear drive. In one embodiment the speed reduction means is an internal spur gear fixed on the drive shaft engaging a ring gear mounted coaxially on the auger unit. In another embodiment the speed reduction means is a planetary gear mechanism. A sun gear is fixed on the drive shaft, at least one orbital gear rotatably is mounted on the auger unit, and an external ring gear is fixed with respect to the housing. In this configuration the orbital gear which is in mesh with the sun gear and ring gear and rotates about its axis while its axis, which is mounted on the auger unit, moves about the drive shaft. The auger unit and drive shaft turn in the same direction.

Because the fan rotates at a faster speed, about twice as fast as the auger unit, it is able to keep up even in deep snow. The benefits of a two stage unit are gained without having to mount the fan behind the auger unit and thus the detriments of a second stage are avoided. The efficiency of the present invention is even greater than a two stage unit because the snow is not propeled transversly into a second stage, rather it is moved to the fan and then out. Not only are there the size benefits of a single stage snow caster, but the present invention can even utilize a single stage snow caster housing, thus cutting production costs. In short, the present invention has gained the benefits of both previous types of snow casters without their respective detriments.

Numerous other advantages and features of the present invention will become readily apparent from the following detailed description of the invention, the accompanying examples, and the appended claims.

DETAILED DESCRIPTION OF THE INVENTION

Figure 1:
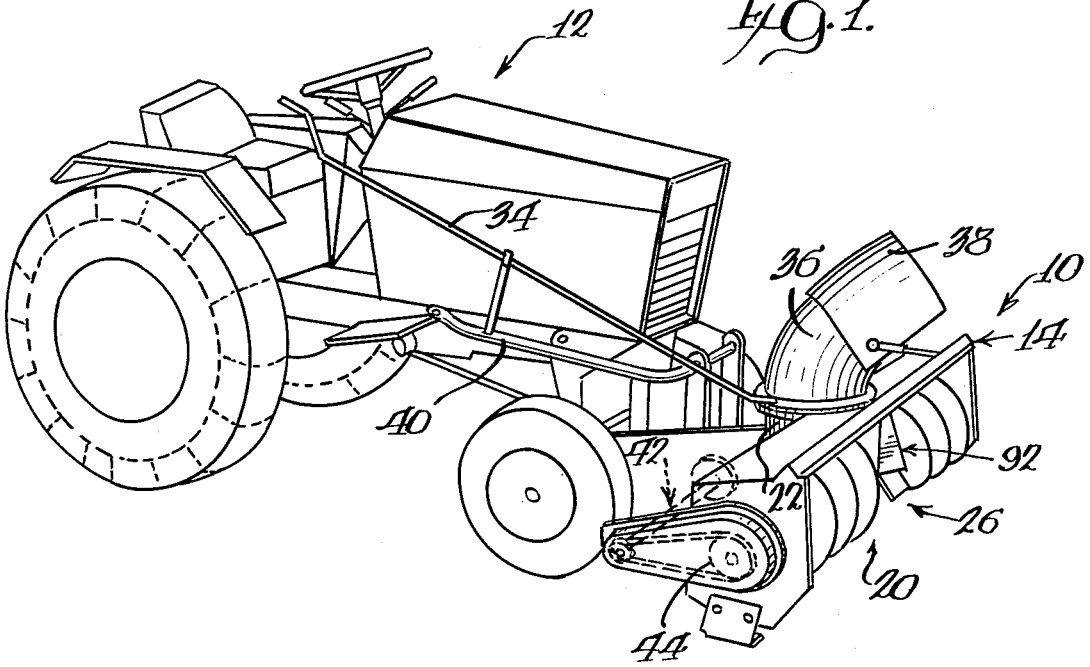
FIG. 1 is a perspective view showing the snow caster of the present invention mounted on the front of a tractor.

While this invention is susceptible of embodiment in many different forms, there is shown in the drawings and will be described in detail, preferred embodiments of the invention. It should be understood, however, that the present disclosures be considered as an exemplification of the principles of the invention and is not intended to limit the invention to the embodiments illustrated.

The precise shapes and sizes of the components described are not essential to the invention unless otherwise indicated. For ease of description, the snow caster of this invention will be described in a normal operating position and such terms as front, back, top, bottom, etc. will be used in reference to this position. The snow caster of this invention has certain conventional drive mechanisms, the details of which, though not fully illustrated or described, will be apparent to those having skill in the art and an understanding of the necessary functions of such mechanisms.

Figure 2:
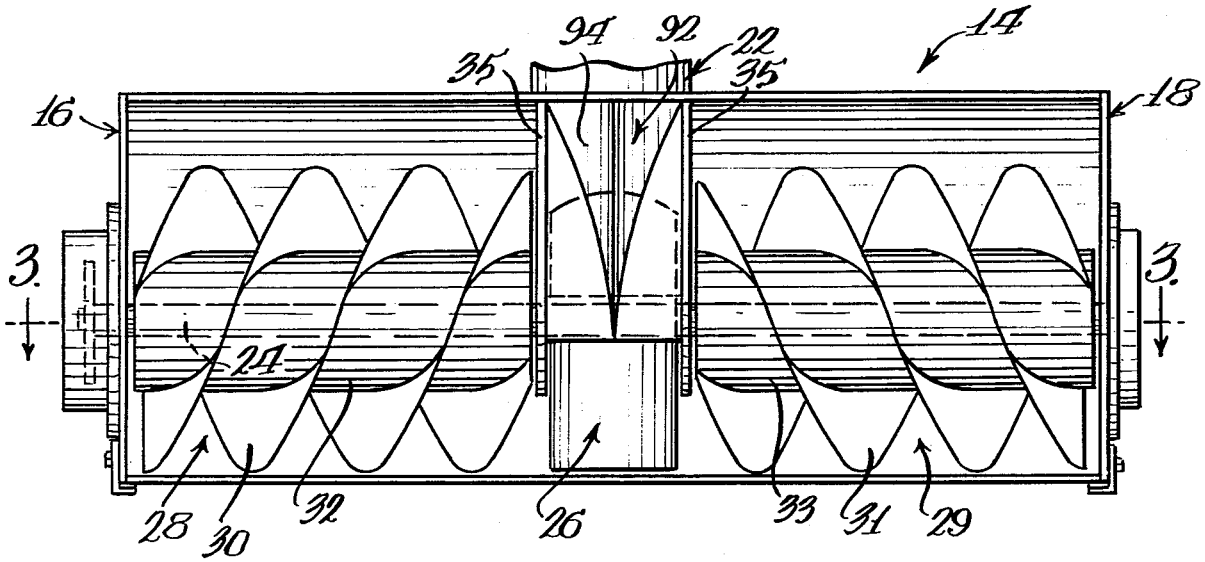
FIG. 2 is an enlarged, fragmentary front elevational view of the snow caster showing auger units and a fan.

Referring to FIG. 1, the snow caster 10 of the present invention is shown mounted on the front of a garden tractor 12. Referring also to FIG. 2, the snow caster generally includes an elongated housing 14 having ends 16 and 18 and an opening extending substantially between the ends defining the front 20 of the housing into which snow is received as the snow caster is moved forward. The housing 14 is also provided with a discharge spout 22 positioned rearwardly of the front and preferably in the central portion of the housing.

A drive shaft 24 is rotatably mounted transversely within the housing 14 and extends substantially to the ends 16 and 18 of the housing. The drive shaft 24 may extend through the ends of housing 14 as shown or may only extend to the ends with the bearings within the housing. If the drive shaft 24 only extends to the ends 16 and 18, the drive shaft may be inserted into the housing 14 from the front. A fan 26 is mounted on the drive shaft 24 adjacent the discharge spout 22 to propel the material such as snow through the discharge spout. The fan 26 is preferably fixed on the drive shaft 24 but may also be provided with speed reduction means to turn the fan faster than the drive shaft. An auger unit 28 having an auger blade 30 fixed on an auger tube 32 is rotatably mounted within the housing 14 with the drive shaft 24 extending into the auger tube.

Preferably, two auger units 28 and 29 are mounted opposite each other with respect to the fan to propel snow toward the fan 26 from both sides. The second auger unit 29 also has an auger blade 31 mounted on an auger tube 33. The auger units 28 and 29 are preferably provided with two sets of auger blades 30 and 31 making up two flights. This increases the volume of snow which is propelled by each auger unit.

The snow caster of the present invention also includes a speed reduction means operably interconnecting the drive shaft 24 and the auger units 28 and 29 such that the auger units are rotatable at a slower speed with respect to the drive shaft. The operation and embodiments of this speed reduction means will be described in more detail later.

Although the drive shaft 24 is shown extending completely through the auger tubes 32 and 33, it is understood that it need not be so fully extended and need only extend partially into an auger tube to provide drive for the speed reducing means. Alternatively, a support 35 can be mounted on the housing 14 extending into the housing to rotatably support the drive shaft 24 adjacent the fan 26 (see also FIG. 5).

One of the advantages of locating the drive shaft 24 within the auger tubes 32 and 33 is that the drive shaft and the speed reducing means are protected from the snow and possible corrosion. This also reduces the total amount of area necessary for mounting the drive for the fan 26 and the auger units 28 and 29.

Referring again to FIG. 1, the operation of the snow caster can easily be controlled by an operator sitting on the tractor 12. A chute crank 34 adjusts the direction of the chute 36 and deflector 38 to aim the propelled snow out of the path being cleared. Deflector 38 sets the elevation of the propelled stream of snow controlling the distance it is thrown. A lift arm 40 is used to raise the snow caster to avoid any obstacles in the path. Power to the snow caster is provided by the tractor through a pulley arrangement to a jack shaft 42 and a chain drive mechanism 44.

Figure 3:
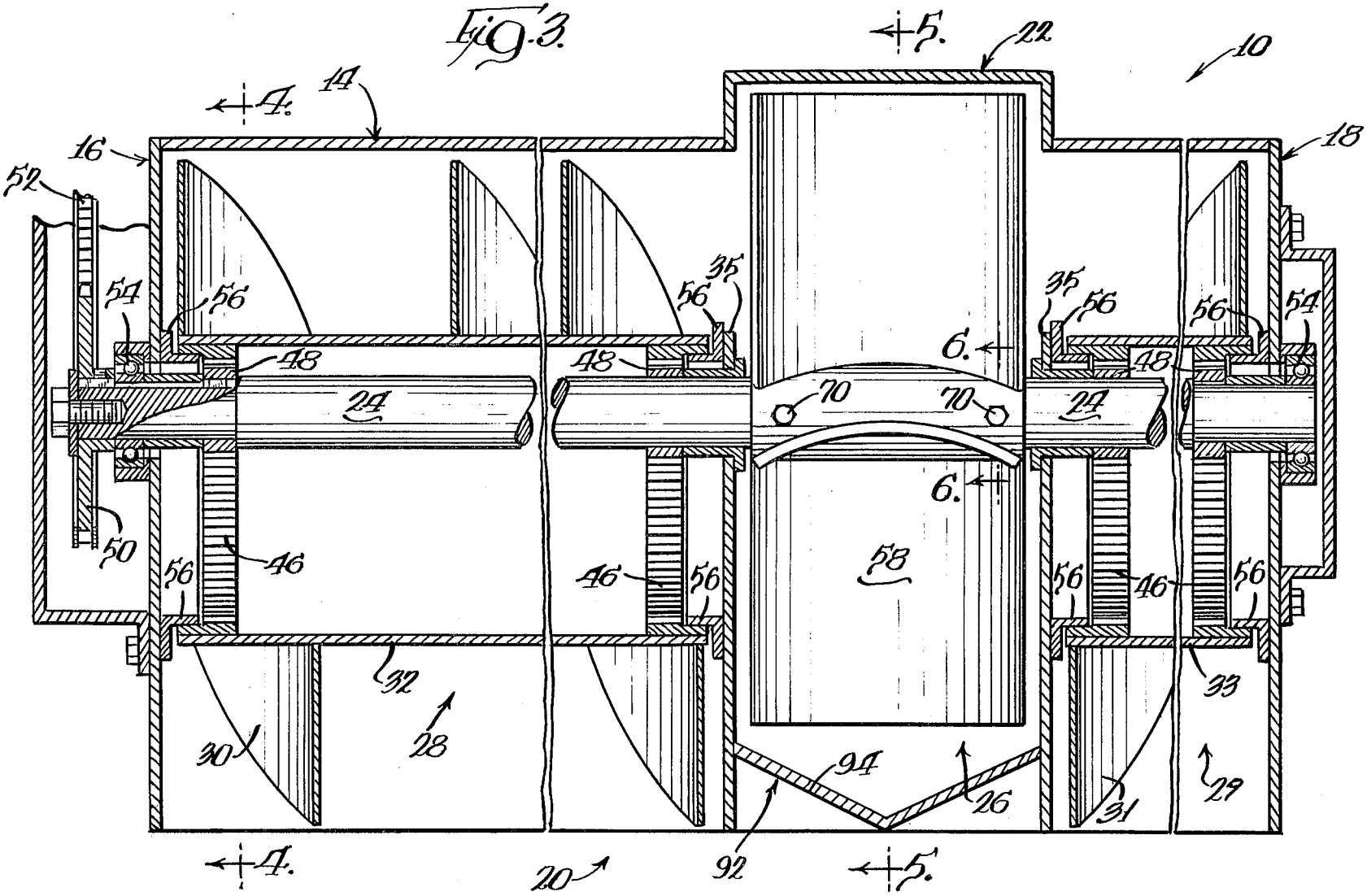
FIG. 3 is an enlarged, fragmentary top plan view showing one embodiment for the speed reduction means as a pinion and ring gear system.
Figure 4:
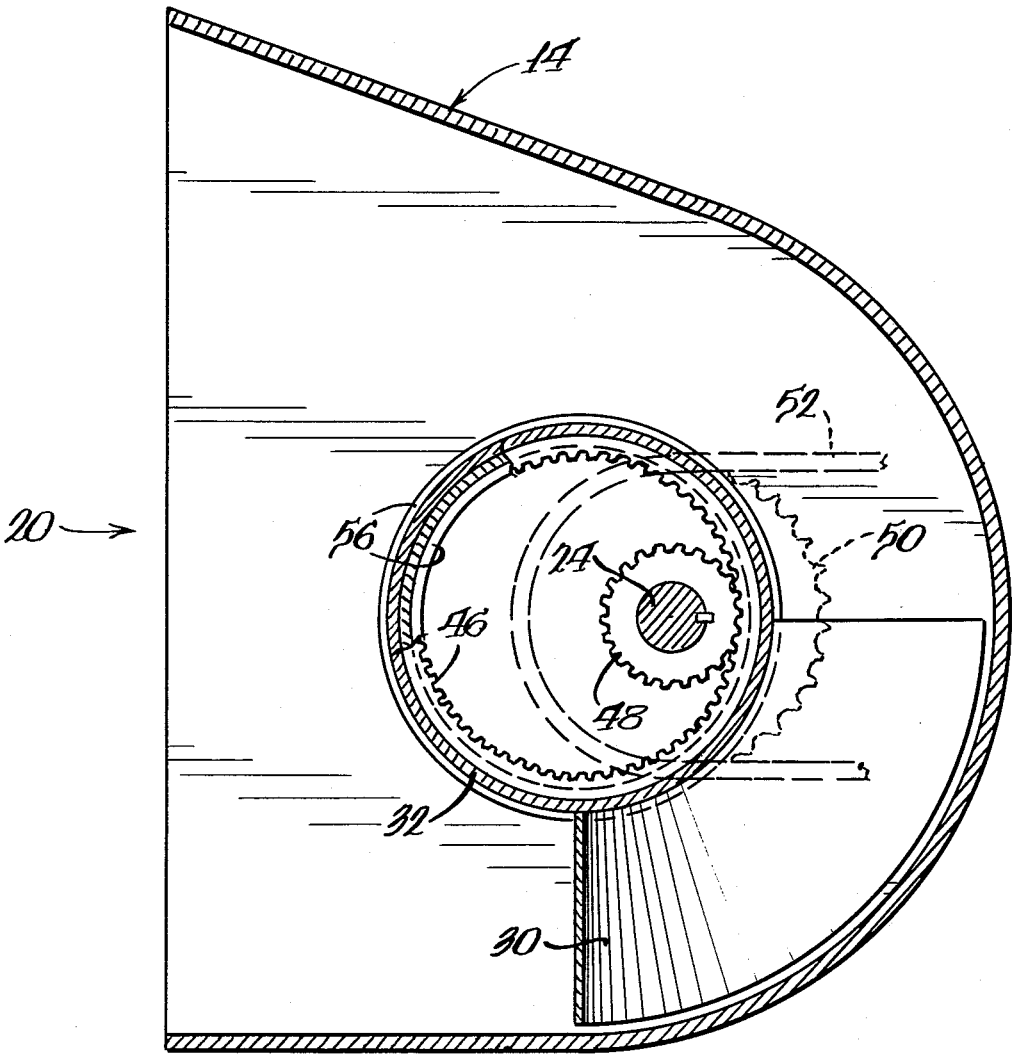
FIG. 4 is a cross-sectional view taken generally along plane 4—4 of FIG. 3 showing the speed reduction means.

One preferred embodiment of the speed reduction means can be seen in FIGS. 3 and 4. The speed reduction means includes a ring gear 46 mounted coaxial on the auger tube and engaged with a spur gear 48 mounted on the drive shaft 24. Preferably, a drive coupling means such as sprocket 50 is mounted on the drive shaft 24 to couple the shaft as by chain 52 to a rotational power source. Alternatively, instead of a sprocket, a gear or pulley system may be used. It is also possible to mount the drive coupling means on the auger unit. Bearings 54 are preferably mounted on the ends of the housing to coact with and align the drive shaft 24. Bushings 56 are also mounted on the housing to coact and align the auger tube.

The speed reduction means may be mounted adjacent the ends 16 and 18 of the housing 14, adjacent the fan 26, or as shown in FIG. 3, there may be four speed reduction means mounted adjacent the fan and both ends. This reduces the torque varation along the drive shaft 24.

As can also be seen in FIG. 3, the fan 26 preferably includes a plurality of paddles 58 having an arcuate cross section. The paddles 58 are preferably arcuate or cup-shaped in cross-section to direct the snow toward a more centralized flow pattern and into the center of the discharge spout 22.

Figure 5:
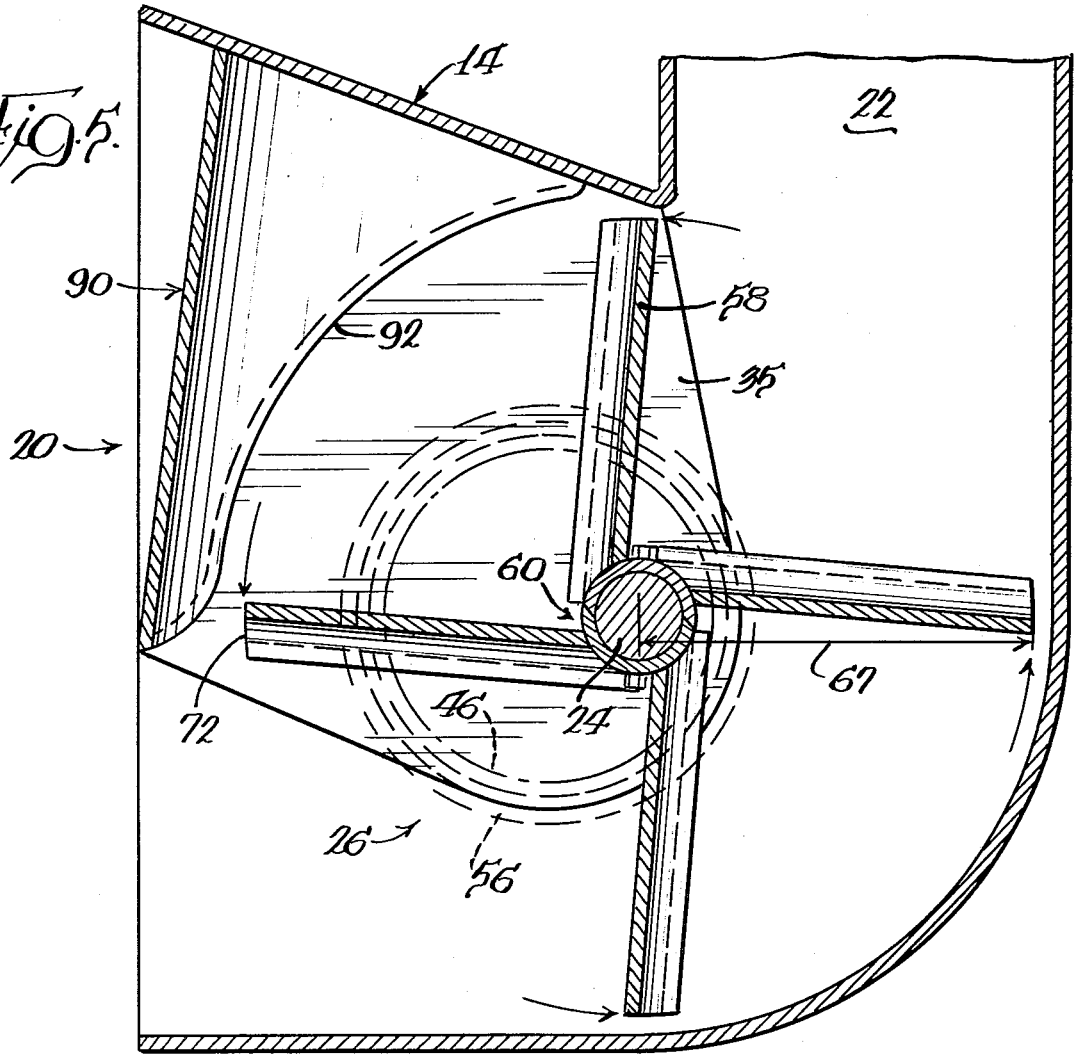
FIG. 5 is a cross-sectional view taken generally along plane 5—5 of FIG. 3 showing the structure of the fan and its hub.
Figure 6:
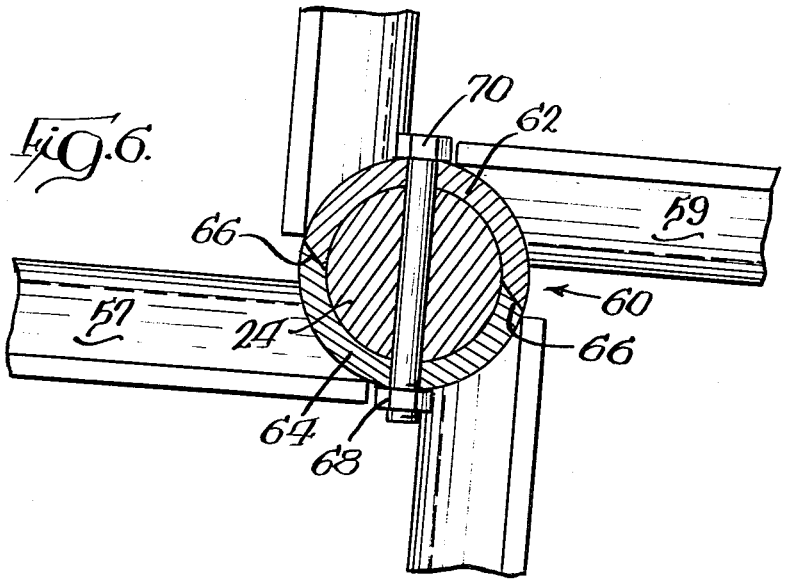
FIG. 6 is an enlarged view of the fan hub.

The positioning of the fan 26 adjacent the discharge spout 22 can best be seen in FIG. 5. The fan 26 may include four paddles as shown, three paddles, two paddles, or only one paddle. Preferably, the fan has a split hub 60 comprised of two hub sections 62 and 64 defining mating surfaces 66 with the paddles 58 mounted on the hub sections. The hub 60 is then removably mounted on the drive shaft 24 and retained on the drive shaft by a nut 68 and bolt 70. Preferably, the mating surfaces 66 are angularly disposed, preferably 45 degrees, against the direction of fan rotation with respect to the diameter of the hub 60 as shown in FIG. 6. The forces generated on paddles 57 and 59 will tend to force the mating surfaces 66 of the hub sections together to keep the seam in the split hub 60 closed. This helps to maintain the hub 60 tightly on the drive shaft 24. The two-piece hub 60 adds to the ease for serviceability by simplifying removal of the fan 26 from the drive shaft 24.

The paddles 58 are also preferably canted about five to fifteen degrees with respect to the diameter of the shaft 24 against the direction of fan rotation. Thus, as seen in FIG. 5, the fan 26 turns counterclockwise and the paddles 58 are canted clockwise with respect to the diameter of the hub as can be seen by line 67. This reduces the friction of snow sliding centrifugically outward toward the ends 72 of the paddles. This also provides a gradual shearing effect on the snow that is coming from the slower rotating auger units 28 and 29 on either side of the fan 26. The ends 72 of the paddles 58 should be radiused as shown in FIG. 5 to provide clearance with the housing 14.

Figure 7:
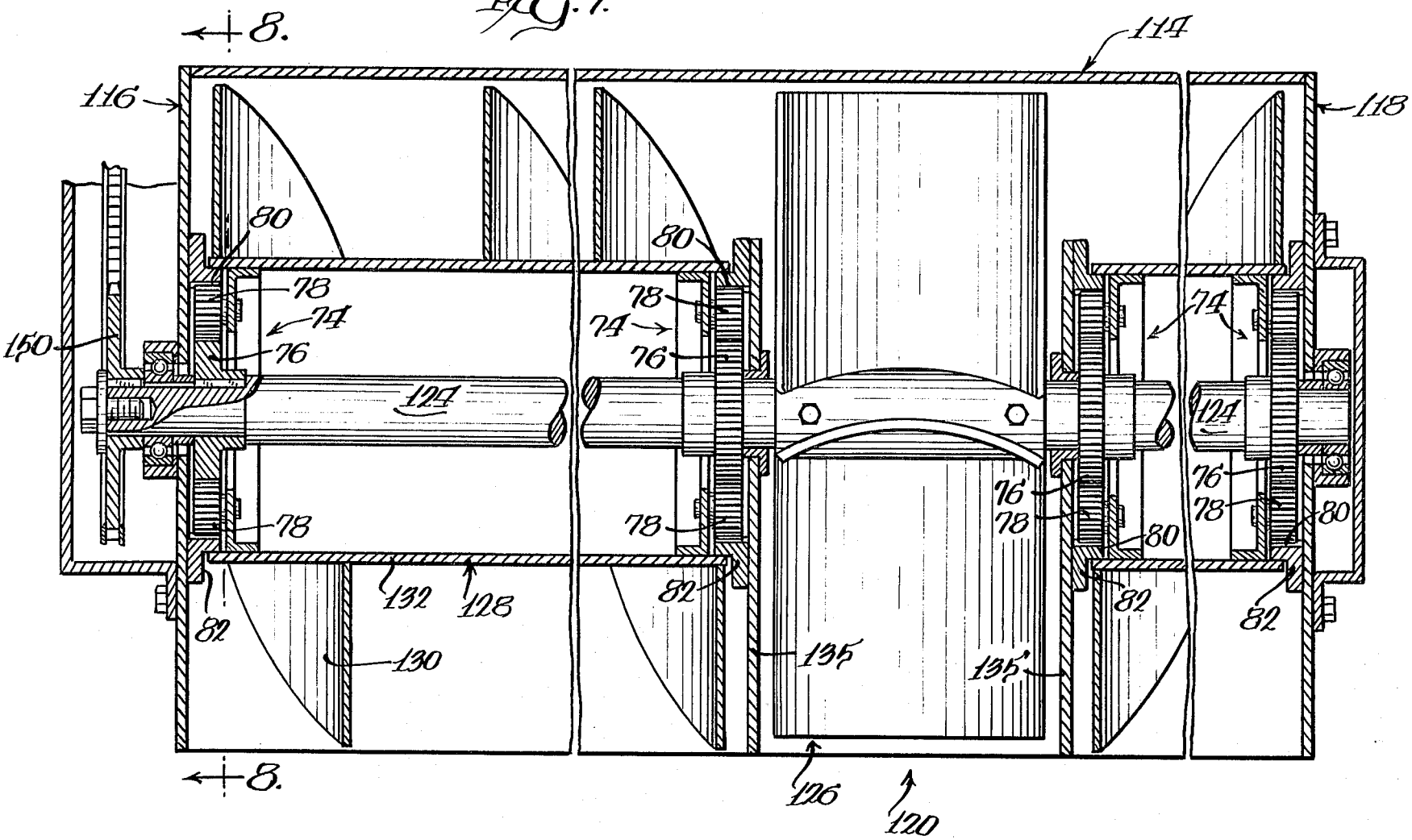
FIG. 7 is a fragmentary, cross-sectional top plan view showing an alternative embodiment for the speed reduction means as a planetary gear mechanism.
Figure 8:
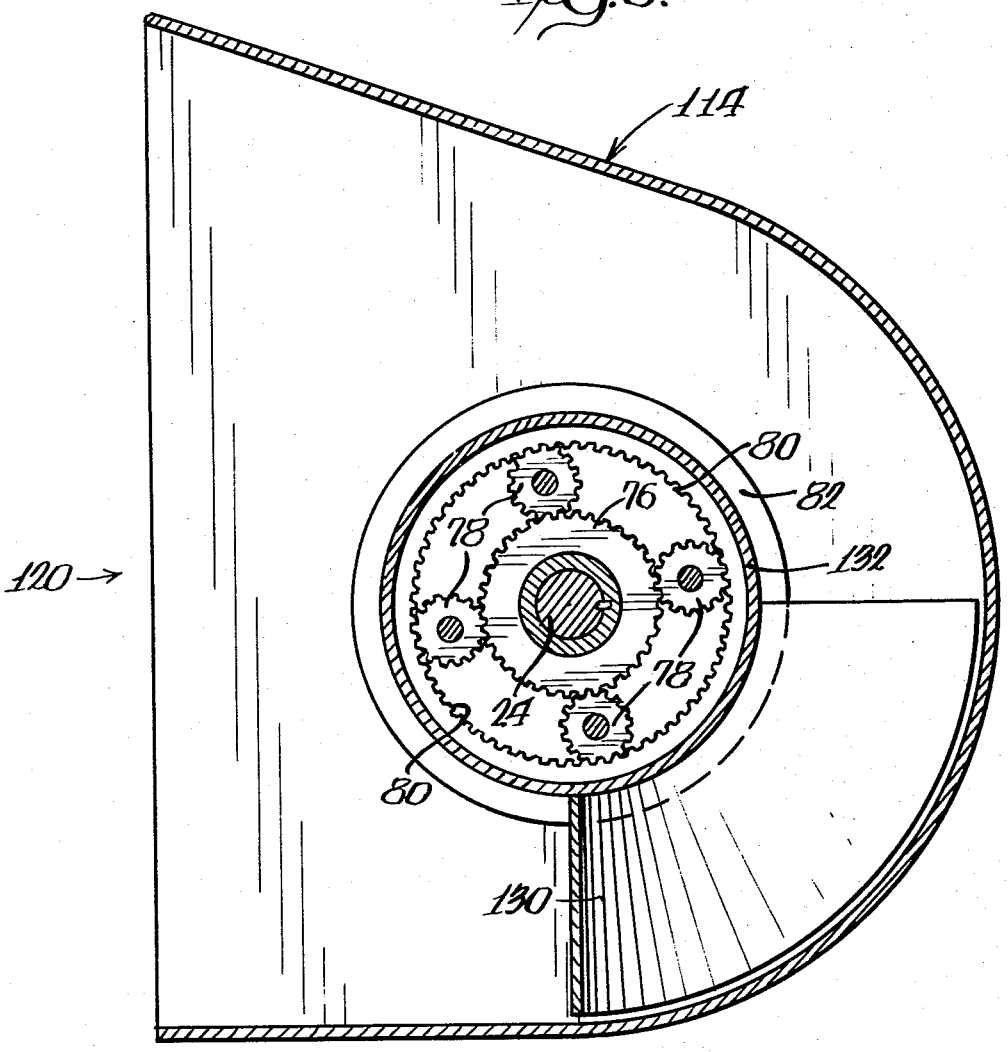
FIG. 8 is a cross-sectional view taken generally along plane 8—8 of FIG. 7 showing the speed reduction means.

An alternative speed reduction means is shown in FIGS. 7 and 8. In this embodiment, the speed reduction means includes a planetary gear mechanism 74 having a sun gear 76 fixed with respect to the drive shaft 124, an orbital gear 78 rotatably mounted on the auger unit 128, and a ring gear 80 fixed with respect to the housing 114. The external surface of the ring gear 80 may also serve as a bushing 82 to coact and align the auger tube 132.

At least one planetary gear mechanism 74 should be provided for each auger unit 128 and may be mounted adjacent the fan 126 with the ring gear 80 affixed on the support 135. Preferably, the planetary gear mechanism 74 may be mounted adjacent the ends 116 and 118 of the housing 114 with the ring gears 80 mounted on the ends. As shown in FIG. 7, the snow caster may be provided with four planetary gear mechanisms 74 mounted adjacent the ends 116 and 118 and the fan 126. The planetary gear mechanism 74 is preferably provided with four orbital gears 78 as can best be seen in FIG. 8.

A snow deflector 90 is mounted on the housing 14 to deflect high drifts of snow away from the fan 26 and into the auger units. See FIGS. 1, 2 and 5. The snow deflector 90 includes a curved deflector plate 92 and a generally V-shaped plow member 94 mounted on the convex side of the deflector plate. The plow member 94 deflects the snow into the auger units as the snow caster is pushed through a high drift. The deflector plate 92 is mounted on the housing adjacent the fan 26 to deflect downward material propelled by the fan toward the opening in front 120. As can be seen in FIG. 5, if the fan 26 attempted to propel snow or more importantly a rock forward of the snow caster, it would strike deflector plate 92 and be deflected downward. This not only prevents snow from being propelled forward into the path being cleared, but also protects against the threat of rocks and the like being thrown forward and possibly injuring passersby.

In operation, a rotational power source such as the tractor is connected as by the sprocket 150 to drive shaft 124. The speed reduction means such as planetary gear mechanisms 74 drive the auger units 128 at about one-half the speed of the drive shaft 124. As the snow caster is moved forward, snow enters the front 120 of the housing 114 and is propelled by the auger units 128 toward the fan 126. The fan then propels the snow through the discharge spout and out away from the vehicle.

As shown in FIG. 7, the fan 126 preferably is the same diameter as the auger units 128. This permits a single stage housing such as 114 to be used for the present invention. This reduces the necessary stock of parts and the cost of production. The present system moves the snow directly into the fan and out through the discharge spout. This avoids the two-stage snow blower problem of moving the snow through several different angles before it is discharged. The present system also has the advantage in that the fan turns at a higher rotational velocity than the auger units, thus allowing it to keep up with snow which is propelled into the fan.

Figure 9:
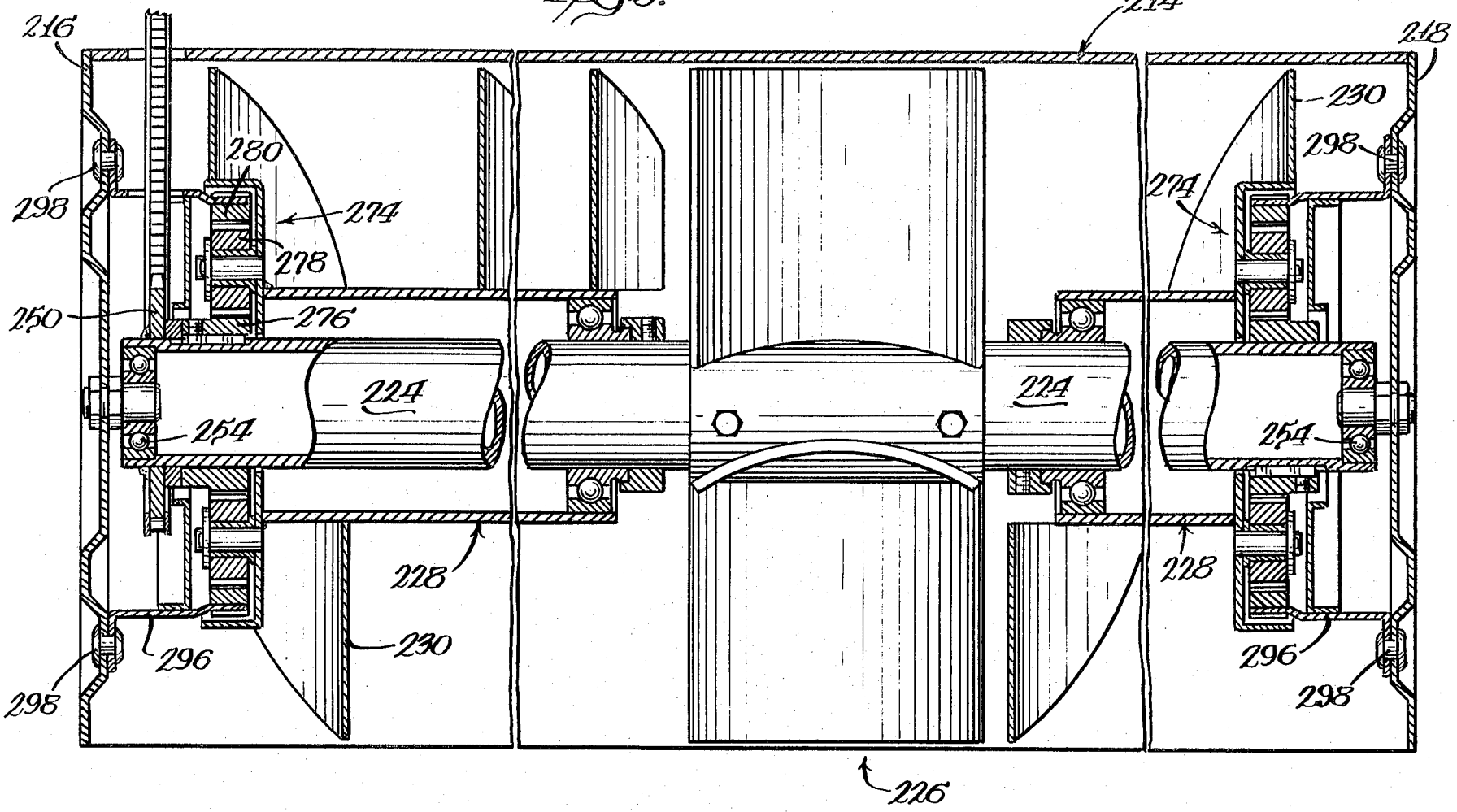
FIG. 9 is a fragmentary, cross-sectional top plan view similar to FIG. 7, but showing the drive shaft mounting within the housing.

FIG. 9 shows an alternative mounting for the drive shaft within the housing. In this embodiment, the drive shaft 224 does not extend beyond the ends 216 and 218 of the housing 214. Similar to the embodiment shown in FIG. 7, the embodiment of FIG. 9 also operates by a planetary gear mechanism 274 having a spur gear 276 mounted on the drive shaft 224, an orbital gear 278 rotatably mounted on the auger unit 228, and a ring gear 280 fixed with respect to the housing 214.

The planetary gear mechanisms 274 and in particular the ring gears 280 are mounted on hollow pedestals 296 extending in from the ends 216 and 218 of the housing 214. The blades 230 partially extend about these pedestals 296 to clear snow near the ends of the housing 214. As before, the auger blades rotate driving the snow towards the fan 226 which then propels the snow out of the unit.

The mounting shown in FIG. 9 has certain advantages. The pedestals 296 are mounted by studs 298 which permit the entire assembly including the auger units and drive shaft to be removed from the front of the housing as a unit. This simplifies construction and facilitates servicing. By having the drive sprocket 250 and the support bearings 254 within the housing, they are protected from damage and the snow caster has improved clean-up ability such as clearing snow along the side of a wall. There are also no guards on the side of the housing which would add resistance when entering the snowdrifts.

The foregoing specification is intended as illustrative and is not to taken as limiting. Still other variations within the spirit and scope of this invention are possible and will readily present themselves to those skilled in the art.

What is claimed is:

1. A snow caster comprising:

(a) an elongated housing having ends and an opening extending substantially between the ends defining the front of the housing, the housing also having a discharge spout positioned rearwardly of the front;

(b) a drive shaft rotatably mounted transversely within the housing;

(c) a fan mounted on the drive shaft adjacent the discharge spout to propel material such as snow through the discharge spout;

(d) an auger unit including an auger blade fixed on an auger tube, the auger unit rotatably mounted within the housing with the drive shaft extending into the auger tube, the auger unit adapted to propel material such as snow toward the fan as the auger unit is rotated; and (e) a planetary gear mechanism having a sun gear fixed on the drive shaft, at least one orbital gear rotatably mounted on the auger unit, and a ring gear fixed with respect to the housing, the planetary gear mechanism operably interconnecting the fan and the auger unit such that the auger unit is rotatable at a slower speed with respect to the fan.

2. The snow caster of claim 1 wherein the drive shaft extends substantially to the ends of the housing, the fan is mounted centrally on the shaft and the snow caster is provided with two auger units mounted opposite each other with respect to the fan, each auger unit being provided with a planetary gear mechanism for operably interconnecting with the drive shaft.

3. The snow caster of claim 2 wherein the planetary gear mechanism are respectively mounted adjacent the ends of the housing.

4. The snow caster of claim 2 wherein the planetary gear mechanisms are respectively mounted adjacent the fan.

5. The snow caster of claim 1 wherein the fan includes paddles having an arcuate cross-section, the diameter of the fan being substantially equal to the diameter of the auger unit.

6. The snow caster of claim 1 including drive coupling means mounted on the shaft adapted to couple the drive shaft to a rotational power source.

7. The snow caster of claim 1 including a bushing mounted on the housing to coact with and align the auger tube.

8. The snow caster of claim 1 including a support mounted on the housing and extending into the housing to rotatably support the drive shaft adjacent the fan.

9. A snow caster comprising:

(a) an elongated housing having ends and a central portion between the ends, the housing having an opening extending substantially between the ends defining the front of the housing, the housing also having a discharge spout positioned in the central portion rearwardly of the front;

(b) a drive shaft rotatably mounted on the housing extending substantially between the ends of the housing;

(c) a fan mounted on the drive shaft for rotation with the drive shaft adjacent the discharge spout to propel material such as snow through the discharge spout, the fan including a split hub comprised of two hub sections, each section defining mating surfaces angularly disposed against the direction of fan rotation with respect to the daimeter of the hub, the fan also including a plurality of fan paddles mounted on the hub sections, the hub being removably mounted on the drive shaft;

(d) two auger units, each auger unit including an auger blade fixed on an auger tube, the auger units rotatably mounted opposite each other with respect to the fan with the drive shaft extending into the auger tubes, the auger units adapted to propel material such as snow toward the fan as the auger unit is rotated; and (e) speed reduction means operably interconnecting the drive shaft and the auger units such that the auger units are rotatable at a slower speed with respect to the fan.

10. The snow caster of claim 9 wherein the speed reduction means includes a ring gear coaxial on each auger tube and two internal spur gears mounted on the drive shaft engaging respective ring gears.

11. The snow caster of claim 9 wherein the speed reduction means includes two planetary gear mechanisms each associated with one of the auger units, each planetary gear mechanism having a sun gear fixed with respect to the drive shaft, at least one orbital gear rotatably mounted on the respective auger units, and a ring gear fixed with respect to the housing.

12. The snow caster of claim 9 wherein the fan includes fan paddles mounted on the shaft canted about 5 degrees to about 15 degrees with respect to the diameter of the shaft against the direction of fan rotation.

13. The snow caster of claim 9 including a snow deflector mounted on the housing adjacent the fan, the snow deflector including a curved deflector plate and a generally V-shaped plow member mounted on the convex side of the deflector plate to deflect material such as unplowed snow toward the auger units, the snow deflector being mounted on the housing such that the deflector plate extends over the opening adjacent the fan to deflect downward material propelled by the fan toward the opening.

14. A snow caster comprising:

(a) an elongated housing having ends and a central portion between the ends, the housing having an opening extending substantially between the ends defining the front of the housing, the housing also having a discharge spout positioned in the central portion rearwardly of the front;

(b) a drive shaft rotatably mounted transversely within the housing with one end of the drive shaft adjacent one end of the housing;

(c) drive coupling means mounted on the one end of the shaft and adapted to couple the drive shaft to a rotational power source;

(d) a fan mounted on the drive shaft for rotation with the drive shaft adjacent the discharge spout to propel material such as snow through the discharge spout;

(e) two auger units, each auger unit including an auger blade fixed on an auger tube, the auger units rotatably mounted opposite each other with respect to the fan with the drive shaft extending through at least one of the auger tubes, the auger units adapted to propel material such as snow toward the fan as the auger unit is rotated;

(f) a ring gear mounted on each auger tube; and (g) two internal spur gears fixed on the drive shaft engaging with respective ring gears.

15. The snow caster of claim 14 wherein the ring gears and spur gears are mounted adjacent the ends of the housing.

16. The snow caster of claim 14 including a support mounted on the central portion of the housing and extending into the housing to rotatably support the drive shaft adjacent the fan and wherein the ring gears and spur gears are mounted adjacent the fan.

17. The snow caster of claim 16 including a second ring gear mounted on each auger unit adjacent the ends of the housing and also including two additional internal spur gears mounted on the drive shaft engaging respective second ring gears.

18. The snow caster of claim 14 including a snow deflector mounted on the housing adjacent the fan, the snow deflector including a curved deflector plate and a generally V-shaped plow member mounted on the convex side of the deflector plate to deflect material such as unplowed snow toward the auger units, the snow deflector being mounted on the housing such that the deflector plate extends over the opening adjacent the fan to deflect downward material propelled by the fan toward the opening.

19. The snow caster of claim 14 wherein the fan includes fan paddles mounted on the shaft canted about 5 degrees to about 15 degrees with respect to the diameter of the shaft against the direction of fan rotation.

20. The snow caster of claim 19 wherein the fan includes fan paddles mounted on the shaft canted about 5 degrees to about 15 degrees with respect to the diameter of the shaft against the direction of fan rotation.

21. A snow caster comprising:

(a) an elongated housing having ends and a central portion between the ends, the housing having an opening extending substantially between the ends defining the front of the housing, the housing also having a discharge spout positioned in the central portion rearwardly of the front;

(b) a drive shaft rotatably mounted on the housing extending substantially between the ends of the housing;

(c) drive coupling means mounted on the shaft adapted to couple the drive shaft to a rotational power source;

(d) a fan mounted on the drive shaft for rotation with the drive shaft adjacent the discharge spout to propel material such as snow through the discharge spout;

(e) two auger units, each auger unit including an auger blade fixed on an auger tube, the auger units rotatably mounted opposite each other with respect to the fan with the drive shaft extending into the auger tubes, the auger units adapted to propel material such as snow toward the fan as the auger unit is rotated;

(f) a bushing mounted on each end of the housing to coact and align the auger tubes;

(g) at least one orbital gear rotatably mounted on each auger unit;

(h) two sun gears mounted on the drive shaft engaging respective orbital gears; and (i) two ring gears fixed with respect to the housing engaging with respective orbital gears.

22. The snow caster of claim 21 wherein the ring gears are mounted on ends of the housing.

23. The snow caster of claim 21 including a support mounted on the central portion of the housing and extending into the housing to rotatably support the drive shaft adjacent the fan and wherein the ring gears are mounted on the support.

24. The snow caster of claim 21 including a second orbital gear rotatably mounted on each auger unit adjacent the ends of the housing and also including two additional sun gears mounted on the drive shaft and two additional ring gears mounted on the ends of the housing, the addition sun and ring gears engaging respective second orbital gears.

25. The snow caster of claim 21 including a snow deflector mounted on the housing adjacent the fan, the snow deflector including a curved deflector plate and a generally V-shaped plow member mounted on the convex side of the deflector plate to deflect material such as unplowed snow toward the auger units, the snow deflector being mounted on the housing such that the deflector plate extends over the opening adjacent the fan to deflect downward material propelled by the fan toward the opening.

* * * * *